US005131540A

United States Patent [19]

Torterotot

[11] Patent Number: 5,131,540

[45] Date of Patent: Jul. 21, 1992

[54] GROUP OF RECEPTACLES CONNECTED WITH RIGID STRIP

[75] Inventor: Roland M. Torterotot, Longvilliers, France

[73] Assignee: Erca Holding, Les Ulis Cedex, France

[21] Appl. No.: 660,539

[22] Filed: Feb. 25, 1991

[30] Foreign Application Priority Data

Feb. 26, 1990 [FR] France ..... 90 02338

[51] Int. Cl.[5] ..... B65D 65/00

[52] U.S. Cl. ..... 206/427; 206/813

[58] Field of Search ..... 206/427, 431, 145-161, 206/139, 813

[56] References Cited

U.S. PATENT DOCUMENTS

| | | | |
|---|---|---|---|
| 2,018,005 | 10/1935 | Barnby | 206/427 |
| 2,903,128 | 9/1959 | Brunsing | 206/159 |
| 2,913,105 | 11/1959 | Brunsing | 206/156 |
| 3,055,497 | 9/1962 | Brunsing | 206/161 |
| 3,094,210 | 6/1963 | Den Berg | 206/153 |
| 3,341,005 | 9/1967 | Poupitch | 206/151 |
| 4,077,516 | 3/1978 | Duerr | 206/432 X |

FOREIGN PATENT DOCUMENTS

| | | |
|---|---|---|
| 1929152 | 12/1970 | Fed. Rep. of Germany . |
| 2193385 | 2/1974 | France . |
| 2486916 | 1/1982 | France . |
| 2533891 | 4/1984 | France . |

*Primary Examiner*—William I. Price

*Attorney, Agent, or Firm*—Blakely Sokoloff Taylor & Zafman

[57] ABSTRACT

The invention relates to a group of receptacles comprising at least two rows of receptacles (P), each receptacle comprising an upper flange (C) and being substantially spaced from the neighboring receptacles in its zone situated below the flange, and the receptacles being secured to one another in the region of their upper ends by their flanges, characterized in that it comprises in the region of the bottoms (F) of the said receptacles at least one thin and essentially rigid reinforcing strip (B) extending in the direction of the said rows and adhesively bonded locally to the bottoms of the receptacles of two adjacent rows.

11 Claims, 4 Drawing Sheets

GROUP OF RECEPTACLES CONNECTED WITH RIGID STRIP

Figure 1:
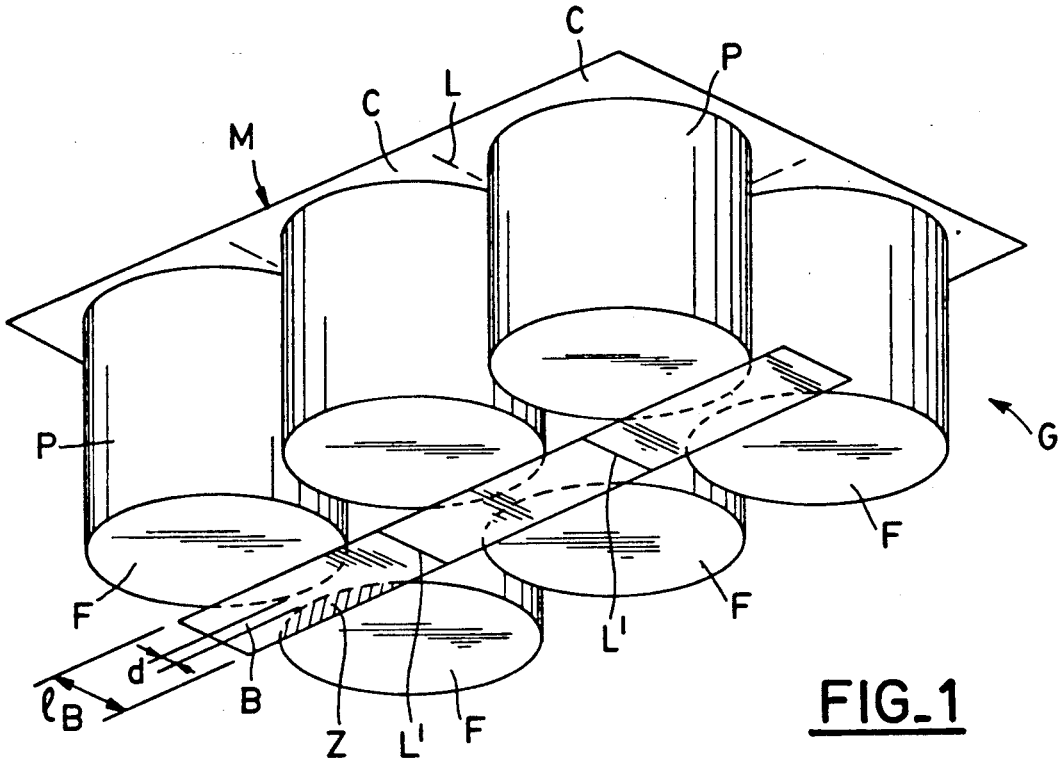

The present invention relates in a general manner to the field of packaging, and it concerns more precisely a group of receptacles, in particular for food products, having an improved construction; it also concerns a method for obtaining such groups of receptacles.

In a now conventional manner, some food products such as yoghurts, desserts and the like are packed in pots which are presented for sale in the form of groups. For this purpose, each pot comprises an upper flange on which there is fixed a peelable lid, and this flange is used to secure the pot to its neighbours, via a rectilinear zone of greater fragility which will subsequently make it possible to separate the pots from one another. Below their flanges, the pots are narrower and are substantially spaced apart from one another.

Thus, when the number of pots is large (for example two rows of three or two rows of four), merely securing the pots together by their upper flanges proves to be inadequate. More precisely, since the cumulative weight of the filled pots has increased, forces may be exerted during their handling which cause the pots to be moved closer together or spaced further apart, which involves the risk of breaking the zones of greater fragility which limit the flanges for the different pots relative to one another.

A widely know solution to this problem consists, as soon as the number of pots becomes excessive, in surrounding the group of pots by means of a cardboard jacket formed from a blank folded around the said group and locked.

This solution is of course expensive. It furthermore requires the provision in advance of the number of pots that will be contained in each group at the exit of the production line, in order to be able to use the blanks adapted to this number and to direct the pots towards the appropriate outer-packaging machines.

Moreover, the solution is known which consists in surrounding a group of pots or a plurality of superposed groups by means of a jacket made of shrinkable transparent plastic material with, if appropriate, the interposition of a decorative cardboard. Although the cost is then slightly reduced, there exists however a major disadvantage according to which the shrinking of the jacket, for example heat shrinking, forces the bodies of the pots of the lower group to be moved closer together by pivoting (flexion at the level of their flanges), with the result that the group no longer possesses a generally flat bottom, thus resulting in problems of storage or presentation for sale.

The present invention aims to overcome these disadvantages of the prior art and to propose a group of receptacles which does not require any outer packaging of the jacket type or the like to reinforce its structure and whose construction is particularly economical.

Another objective is to achieve these aims while maintaining a satisfactory appearance of the group of receptacles.

To this end, according to a first aspect, it relates to a group of receptacles comprising at least two rows of receptacles, of the type comprising means for securing the receptacles to one another in the region of their upper ends, characterised in that it comprises in the region of the bottoms of the said receptacles at least one thin and essentially rigid reinforcing strip extending in the direction of the said rows and adhesively bonded locally to the bottoms of the receptacles of two adjacent rows.

According to a second aspect, the invention relates to a group of receptacles comprising a row of receptacles, each receptacle comprising an upper flange and being substantially spaced from the neighbouring receptacles in its zone situated below the flange, and the receptacles being secured to one another in the region of their upper ends by their flanges, characterised in that it comprises in the region of the bottoms of the said receptacles a thin and essentially rigid reinforcing strip extending in the direction of the said row and adhesively bonded locally to the bottoms of the recptacles.

According to a third aspect, the invention relates to an assembly consisting of at least two groups of superposed receptacles, each group comprising at least two rows of receptacles, each group comprising means for securing the receptacles to one another in the region of their upper ends, characterised in that it comprises in the region of the bottoms of the receptacles of the lower group at least one thin reinforcing strip extending in the direction of the said rows and adhesively bonded locally to the bottoms of the receptacles of two adjacent rows, in that the or each strip comprises at each end a first extension extending essentially vertically along the end receptacles of each group and a second extension extending essentially horizontally and adhesively bonded on an essentially plane upper surface of the upper group of receptacles.

Finally, according to a fourth aspect, the invention relates to a method for producing groups of reinforced receptacles, each comprising at least two rows of receptacles and comprising means for securing the receptacles to one another in the region of their upper ends, characterised in that it comprises the steps consisting in:

- displacing a continuous length of the said two rows at least provided with receptacles;
- gluing at least one continuous length of a thin reinforcing strip;
- affixing the said strip or strips in the region of the bottoms of the said receptacles in such a manner as to affix it or them locally to the bottoms of the receptacles of two respective adjacent rows as the continuous length of rows of receptacles is displaced; and
- sectioning the said securing means and the said strip or strips at regular intervals corresponding to a complete number of receptacles.

Figure 2:
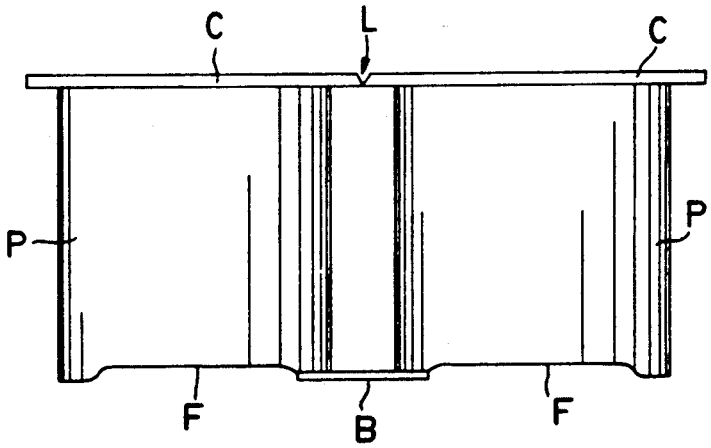
Figure 3:
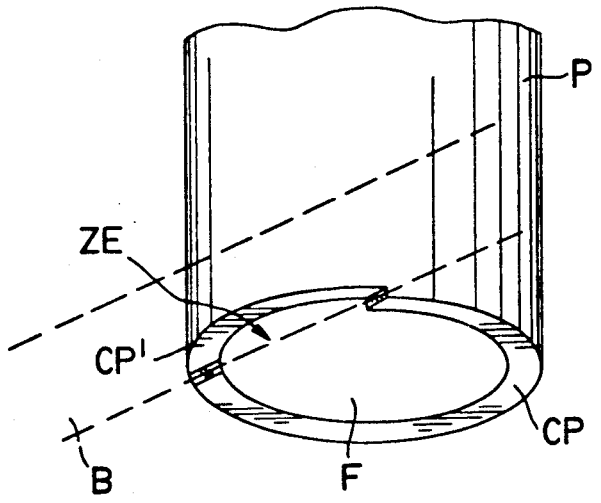
Figure 4:
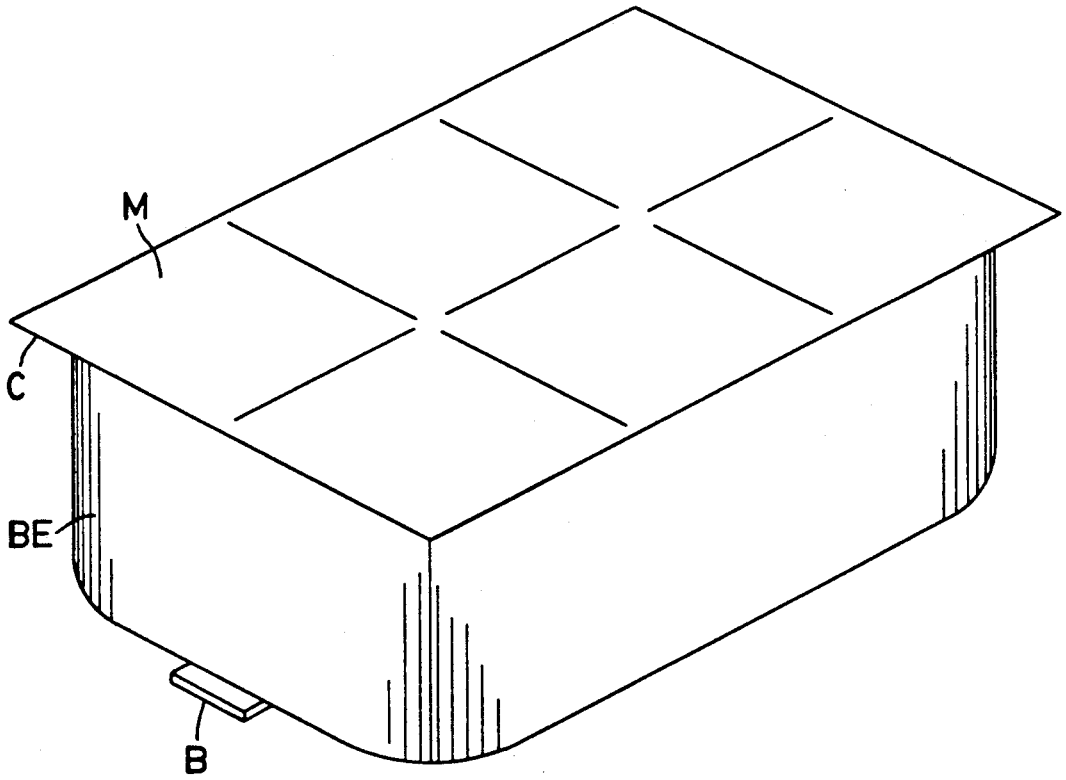
Figure 3A:
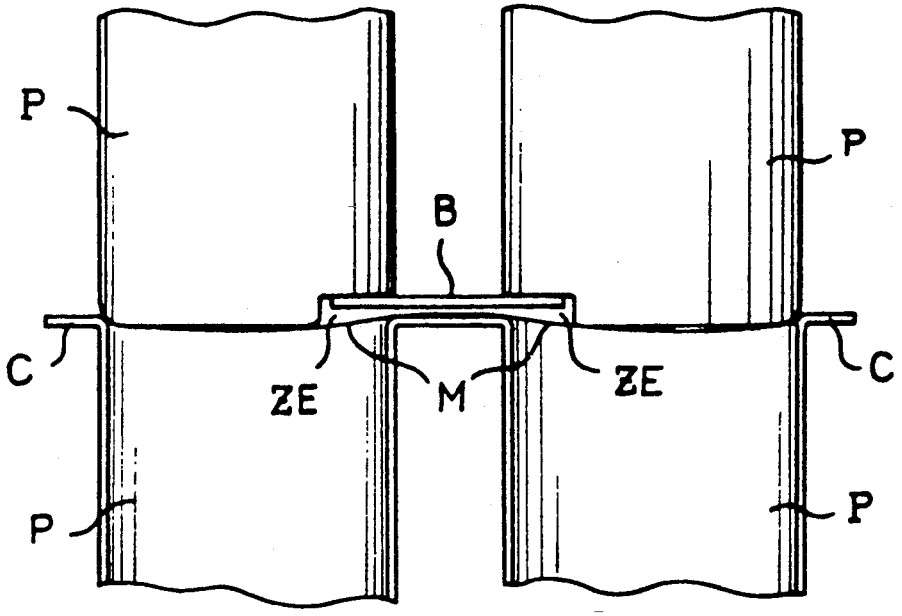
Figure 7A:
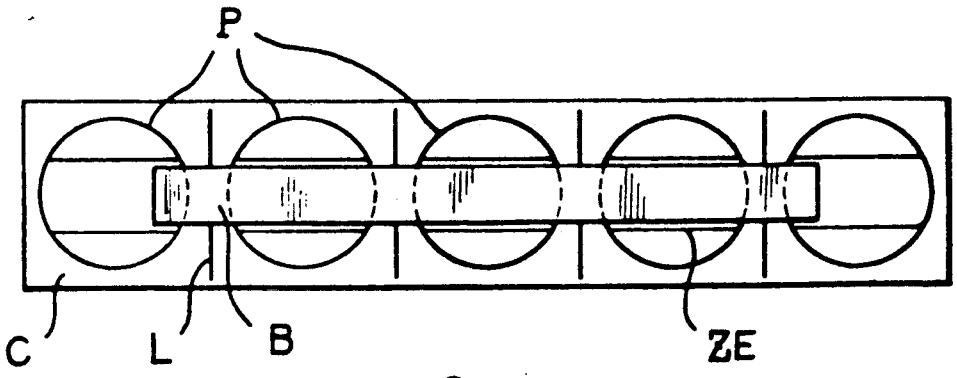
Figure 7B:
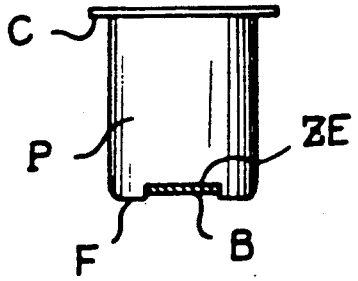
Figure 5:
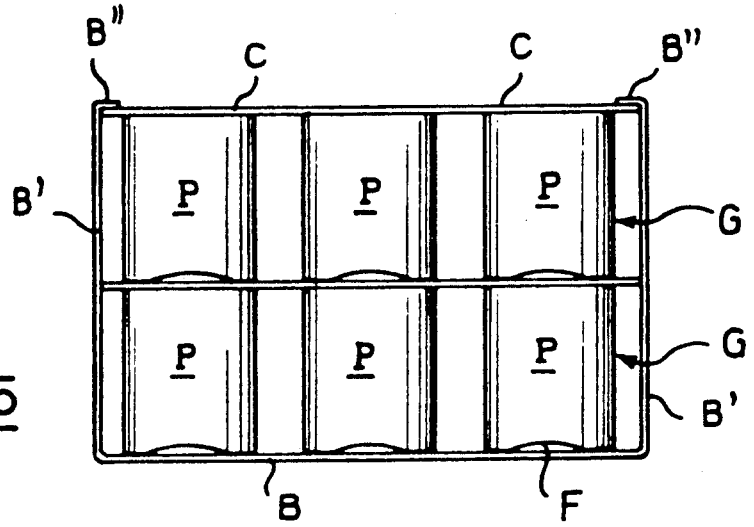
Figure 6:
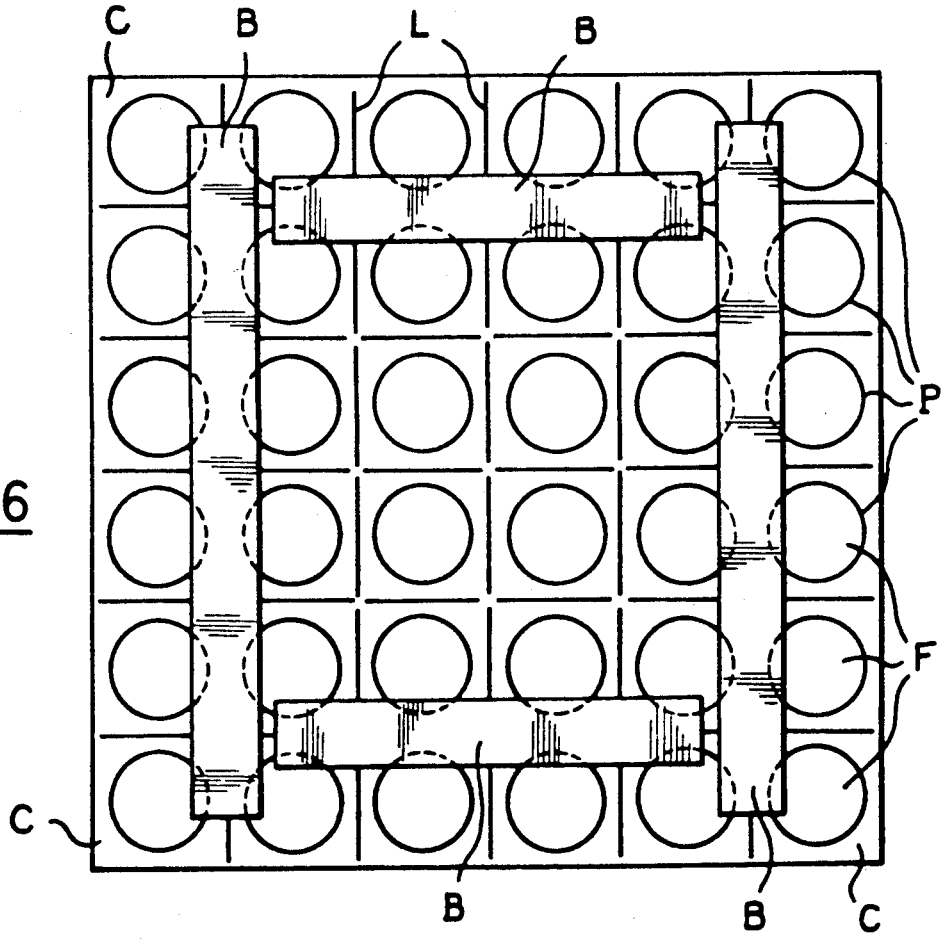

Other aspects, objects and advantages of the present invention will become more clearly apparent on reading the detailed description which follows of preferred embodiments of the invention, given by way of non-limiting example and with reference to the accompanying drawings, in which:

FIG. 1 is a perspective bottom view of a group of pots equipped with a reinforcing means according to the invention, FIG. 2 is a cross-sectional view of the group of pots of FIG. 1, FIG. 3 is a perspective view of a detail of the invention, FIG. 3A is a view in vertical section of a group of pots incorporating the detail of FIG. 3, FIG. 4 is a perspective plan view of a group of pots according to the invention, complemented by a decorative element, FIG. 5 is a side view in elevation of an alternative embodiment of the invention, FIG. 6 is a diagrammatic bottom view of a group of receptacles illustrating another variant of the invention, and FIGS. 7A and 7B are respectively bottom and vertical-section views of a group of receptacles illustrating yet another variant of the invention.

It will be indicated first of all that, from one figure to the next, identical or similar parts or elements are designated by the same reference numerals.

With reference first of all to FIGS. 1 to 3, a group of receptacles, in the present example pots of yoghurt or suchlike dairy produce, have been represented. Each pot P comprises an upper flange C and a thin closing membrane M fixed on the upper face of the flange C by a suitable adhesive. The flanges C of the various pots are connected together by their rectilinear edges, along lines L of greater fragility, for example grooved lines, which subsequently permit the separation of the pots.

In concrete terms, such a group of pots is produced by a single moulding operation, in a conventional manner per se, while the membranes M are produced from an element in a single sheet.

In the present example, the group comprisees two rows of three pots, these numbers, however, in no way representing any limitation.

According to an essential aspect of the invention, in order to prevent excessive forces from being capable of separating the pots from one another by breaking for example along the divisible lines L, during the handling of the group of pots filled with their respective contents, there is provided in the region opposite the flanges C, in this instance in the region of the bottom F of the pots, a reinforcing beam in the form of a thin strip B which extends here in the longitudinal direction of the group of pots and in the median region of the bottom.

This strip B has a width $1_B$ which is slightly greater than the distance d between the bottoms of the respective pots, so as to be able to come into contact with each bottom over a zone (hatched zone Z) delimited on one side by the inner edge of the bottom and on the other side by the edge of the strip B under consideration. The connection between the strip B and each bottom F is preferably effected by an adhesive having an adhesive force selected such that the strip may be separated from the bottoms F with a reasonable force exerted manually. A permanent glue (non-drying) which is compatible with the respective materials of the pots and the reinforcing strip is advantageously used.

The glue may occupy all the surface of contact between the strip and the bottoms of the pots; but preferably, a punctiform adhesive bonding is carried out, with for example from 1 to 3 points of glue at the level of each zone of contact.

The rigidity of the strip B is chosen as a function of its width and of the weight of the pots, this weight being a good representation of the size of the compressive and tractive forces which may be exerted on the strip when the group of pots is seized for example by one of its longitudinal ends. For example, it is possible to use a strip of a plastic material such as polystyrene, of a thickness of the order of 0.4 to 0.6 mm. Moreover, given the fact that the reinforcing strip never comes into contact with the foods contained in the pots, it is not necessary to produce it with a plastic material for food, and it is advantageously produced from a recycled plastic material.

Moreover, it may be advantageous to produce the strip in a transparent plastic material, in particular for the purpose of rendering it less perceptible and improving the presentation of the group of pots.

By virtue of the present invention, a group of pots is obtained with a very great rigidity and may be handled without particular precautions without there being any risk of breakage, given the fact that, in particular, the fragile lines L separating the individual pots are not exposed to flexion moments as was the case in the prior art.

With reference now to FIG. 3, in the case where the thickness of the strip B is large enough to hamper the stacking of a large number of groups of pots (given that the bottom of the group of pots is then no longer perfectly flat), there is provided in each pot bottom F a slightly recessed embedding zone ZE which makes it possible for the strip B not to protrude in a downward direction relative to the bottoms while being substantially flush with the said bottoms outside the embedding zones.

In the example, shown, each bottom F comprises a slightly projecting peripheral ring CP which constitutes the seat of the pot. This ring CP is simply offset in height towards the top of the pot in a zone CP' which corresponds to the position of the reinforcing strip B (illustrated in broken lines for the sake of clarity). This zone CP' can correspond fairly exactly to the final position of the strip. In this case, the zones CP' of each of the pot bottoms may, conjointly, take the place of means of assistance in the positioning of the strip B during the fixing thereof. Of course, this recessed zone CP' may also be greater than the size which is necessary for accommodating the strip. Furthermore, the height offset between the recessed zone CP' and the remainder of the peripheral ring is advantageously approximately equal to the thickness of the received strip, or else slightly greater than this thickness.

Of course, in the case where the strip B is sufficiently thin, or else in cases where it is not necessary to ensure good stability for stacking, the recesses provided in the bottom of the pots for receiving the strip may be dispensed with.

Shown in FIG. 3A is an assembly of two groups of superposed pots, each pot bottom comprising an embedding zone ZE whose depth is slightly greater than the thickness of the strip B. Conventionally, when two groups are stacked one on top of the other, the bases of the pots of the upper group, which cannot bear against the flanges of the pots of the lower group, slightly deform the closing membrane M of the respective pots situated plumb therewith, as illustrated. By providing embedding zones of adequate depth, the upper group is thus prevented from bearing on the flanges of the lower pots, the lower group only essentially at the level of the strip B. In this manner, the upper group bears against the lower group in a manner which is well distrubuted laterally, and as far as the outer edges of the base of the pots, such that a good stability on stacking is guaranteed even when a stacking of a large number of groups is performed.

With reference now to FIG. 4, there has been shown a reinforced group of pots according to the present invention and provided with a decorative element. This decorative element consists of a banderole BE which envelops the pots P laterally, the said pots advantageously having in this case vertical walls. According to an advantageous aspect of the invention, the reinforcing strip B is cut at its two ends so as to protrude slightly relative to the bodies of the pots. For example, these ends may be situated plumb with the edges of the flanges of the end pots in the longitudinal direction. These protruding ends of the strip are advantageously used, as illustrated, to keep the banderole in place and prevent it leaving the group of pots by sliding. The banderole is thus enclosed between the flanges C of the pots at the top and the ends of the strip B at the bottom. An essential advantage of this arrangement resides in the fact that it is not necessary to provide adhesive bonding or the like to keep the banderole in place.

Moreover, since the banderole BE has no function in keeping the pots together (this function being filled conjointly by the flanges C and the strip B), it may be produced in the form of a relatively thin paper, and therefore economically.

FIG. 5 illustrates another variant of the present invention. According to this variant, the reinforcing strip B also constitutes a means for securing two groups of pots, preferably of the same size, one on top of the other, each of these groups being designated by the reference G. For this purpose, the strip is extended at each end beyond its reinforcing part proper. It is first of all bent upward at 90° so as to run alongside the pots (section B'), at right angles to the longitudinal space which separates them, and this being so as far as the top of the upper group. There, it is folded over by 90° towards the inside and adhesively bonded on the upper surface of the said group (section B''). Advantageously, this section B'' is dimensioned and shaped in such a way that its zone of contact with the upper parts of the pots is restricted to the flanges of the end pots alone in the longitudinal direction. In this matter, when another assembly of grouped pots is brought above this assembly, for example during storing, it will be possible for the bases of the pots to come into direct contact with the upper surface of the upper group and accordingly without being influenced in their stability by the extra thicknesses induced by the sections B'' of the strip.

By virtue of this particular aspect of the invention, an assembly of two groups of receptacles is obtained in an economical manner, the appearance of which is completely satisfactory, and superior in particular to the appearance obtained with the conventional use of jackets of heat-retractable transparent plastic material.

According to another variant, and again with reference to FIG. 1, the strip B may comprise, according to a regular pitch corresponding to the longitudinal dimension of the pots and plumb with each transition between two pairs of pots in the transverse direction, transverse lines L' of greater fragility obtained for example by grooving, perforation and the like. Separation of the pots is thus facilitated by providing the possibility of a simple cutting of a portion of the reinforcing strip corresponding to a pair of pots to be removed, without therefore having to pull out said strip in its entirety.

A preferred method of producing a reinforced group of pots in accordance with the present invention will now be described.

In a conventional manner, the pots at the exit of the production line (moulding of the pots, filling and sealing) are present in the form of an uninterrupted length of, for example, two rows of pots maintained together at the level of their flanges as described above.

Advantageously, there is provided at the exit of the line an automated means for gluing and positioning the reinforcing strip on the bottoms of the pots, the reinforcing strip likewise being present in the form of a continuous length.

Preferably, the gluing is carried out immediately before the positioning of the strip.

At this stage, the pots may be separated, at the level of a sectioning station, into groups of, for example, 24 pots. Already at this stage, the reinforcing strip endows these groups with a great rigidity, permitting them to be arranged without the risk of breaking.

This first step for producing discrete groups of pots takes place, for example prior to the conventional operations of sudden heat treating and cooling which are characteristic of the preparation of yoghurts.

Thereafter, the groups of 24 pots may be separated into groups of, for example, four, six, eight or twelve pots, by appropriate sectioning of the flanges along the separating lines L and of the reinforcing strip at the same level.

Subsequently, a banding machine may be used to affix on each group the aforementioned decorative banderole. Advantageously, one and the same banding sheet, in roll form, is used to decorate the groups of pots irrespective of the number of pots in each group.

The results of all this is a much greater flexibility of the production line insofar as it becomes possible to modify at any moment the number of pots in each group without having substantially to modify the equipment, but simply by setting the appropriate parameters at the level of the sectioning and banding stations, in particular.

Of course, the above-indicated intermediate step, according to which the continuous band of pots filled with, for example, 24 units is precut, may be dispensed with. In this case, the continuous band of pots is cut at intervals which make it possible directly to supply groups of pots (for example two rows of two, three or four pots) having the final number of pots. The above-mentioned advantages in respect of production flexibility are of course retained.

According to another aspect of the invention, it is possible to provide, in the production line, a station for affixing bar codes for the identification of products. Advantageously, this bar code may be printed on the reinforcing strip B.

In a particularly preferred manner, the bar-code printing station is provided immediately upstream of the sectioning station, and designed to print successive bar codes whose contents and spacing are determined as a function of the sectioning pitch. In this way, the groups of pots are given, in an extremely simple manner, different identifiers according to the number of pots per group, with a single bar code per group of pots.

It may be emphasised here that the fact of particularly advantageous during the automatic reading of the product codes at the check-outs of food stores. In fact, this reading may thus be performed without having to turn the pots over and therefore without disturbing the presentation of the content thereof.

Moreover, the fact of providing the bar codes on a reinforcing strip avoids having to display these codes on the banderole, if provided. Accordingly, here again, it is possible to use a single banding sheet for groups comprising any numbers of pots.

According to yet another aspect of the present invention, in the case where reinforcing strips according to the present invention are used in a great number for pots or the like which are present in groups comprising a sizeable quantity of rows and columns of pots (in particular in the case of tubs or individual cheese portions such as are encountered more and more frequently), it is possible to provide strips of different colours which will assist the retailer in separating the group of very numerous tubs into sub-groups of quantities which will vary according to the colour of the reinforcing strips along which the separation has been performed.

Of course, the number and the arrangement of the reinforcing strips will be matched to the particular configuration of the group of pots.

Thus, in a general manner, if the groups comprise N rows of pots N−1 reinforcing strips are provided.

According to another variant of the invention, and now with reference to FIG. 6, when the groups of pots comprise a large number of rows and of pots in the two orthogonal directions (36 pots of 6×6 being illustrated in FIG. 6), it may prove to be advantageous to provide reinforcing strips only between the pots situated at the periphery of the group and the pots situated immediately on the interior, as shown, for example in a square arrangement (as illustrated) or in a rectangular arrangement, adapted to the arrangement of the pots.

In this case, it will be noted that it may prove to be superfluous to embed the reinforcing strips in the bottoms of the pots, inasfar as the arrangement of the strips is capable of ensuring a good stability on stacking.

FIGS. 7A and 7B illustrate the particular application of the concept of the present invention to the case of a group of pots or the like arranged in a single row. In this case, the reinforcing strip B is fixed to the center of the bottom F of the pots P. Here again, it is advantageous to provide a recess ZE in the bottom of each pot for the reception of the strip, as illustrated, in order to ensure a satisfactory stability during stacking operations.

Although the above description has been given in connection with groups of pots for dairy produce or the like, it is evident that it applies generally to the reinforcement of any group of similar receptacles, provided with straight or inclined walls (pots widened out towards the top), for food or non-food products. Of course, the present invention is in no way limited to the embodiment described above and shown in the drawings, but a person skilled in the art will be able to apply to it any variant or modification which he sees appropriate.

I claim:

1. Group of receptacles comprising at least two rows of receptacles (P), each receptacle comprising an upper flange (C) and being substantially spaced from the neighbouring receptacles in its zone situated below the flange, and the receptacles being secured to one another in the region of their upper ends by their flanges, characterised in that it comprises in the region of the bottoms (F) of the receptacles at least one thin and essentially rigid reinforcing strip (B) extending in the direction of the rows and adhesively bonded locally to the bottoms of the receptacles of two adjacent rows, further characterised in that in each receptacle bottom to which a reinforcing strip (B) is adhesively bonded there is provided a recess (ZZ, CP') for the strip.

2. Group of receptacles comprising at least two rows of receptacles (P), each receptacle comprising an upper flange (C) and being substantially spaced from the neighbouring receptacles in its zone situated below the flange, and the receptacles being secured to one another in the region of their upper ends by their flanges, characterised in that it comprises in the region of the bottoms (F) of the receptacles at least one thin and essentially rigid reinforcing strip (B) extending in the direction of the rows and adhesively bonded locally to the bottoms of the receptacles of two adjacent rows, further characterised in that in each receptacle bottom to which a reinforcing strip (B) is adhesively bonded there is provided a recess (ZZ, CP') for the strip, and further characterised in that each strip (B) is adhesively bonded by means of a permanent glue.

3. Group of receptacles comprising at least one row of receptacles (P), each receptacle comprising an upper flange (C) and being substantially spaced from the neighbouring receptacles in its zone situated below the flange, and the receptacles being secured to one another in the region of their upper ends by their flanges, characterised in that it comprises in the region of the bottoms of the receptacles at least one thin and essentially rigid reinforcing strip (B) extending in the direction of the at least one row and adhesively bonded locally to the bottoms of the receptacles.

4. Group of receptacles according to claim 3, characterised in that each receptacle bottom (F) comprises a recess (ZE) for the strip, extending essentially centrally and in the longitudinal direction of the group.

5. Group of receptacles according to claim 3, comprising at least two rows of receptacles (P), wherein the at least one reinforcing strip (B) is adhesively bonded locally to the bottoms of the receptacles of two adjacent rows.

6. Group of receptacles according to claim 5, characterised in that each strip (B) is adhesively bonded in a punctiform manner.

7. Group of receptacles according to claim 5, characterised in that each strip (B) is produced from a plastic material whose thickness is selected as a function of the weight, of the volume and of the number of receptacles and is between approximately 0.2 and 1 mm.

8. Group of receptacles according to claim 5, characterised in that the free end of each strip (B) protrudes relative to the contours of the receptacles in the region of their bottoms.

9. Group of receptacles according to claim 5, characterised in that each strip (B) carries a bar code for the identification of the group of receptacles.

10. Group of receptacles according to claim 5, comprising a large number of rows of receptacles, characterised in that it comprises a plurality of reinforcing strips (B) whose colours vary as a function of their position in the group.

11. Group of receptacles according to claim 5, characterised in that each reinforcing strip (B) possesses a line of greater fragility plumb with at least one transition between two receptacles.

* * * * *